US008701309B2

(12) United States Patent
Park et al.

(10) Patent No.: US 8,701,309 B2
(45) Date of Patent: Apr. 22, 2014

(54) DRYER

(75) Inventors: Hee Beom Park, Anyang-si (KR); Phil Soo Chang, Seongnam-si (KR); Hyung Woo Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 306 days.

(21) Appl. No.: 13/311,923

(22) Filed: Dec. 6, 2011

(65) Prior Publication Data

US 2012/0144692 A1 Jun. 14, 2012

(30) Foreign Application Priority Data

Dec. 13, 2010 (KR) ..... 10-2010-0126854

(51) Int. Cl.
*F26B 11/02* (2006.01)

(52) U.S. Cl.
USPC ..... 34/487; 34/491; 34/595; 34/610; 68/275; 8/142; 236/46 C

(58) Field of Classification Search
USPC ..... 34/381, 487, 491, 595, 601, 603, 606, 34/610; 68/5 C, 5 R, 19, 20, 275; 8/132, 8/142, 159; 236/46 C, 94
See application file for complete search history.

(56) References Cited

U.S. PATENT DOCUMENTS

| | | | | |
|---|---|---|---|---|
| 3,861,057 | A * | 1/1975 | Wittstock et al. | 34/569 |
| 4,668,908 | A * | 5/1987 | Aoki et al. | 323/324 |
| 5,495,418 | A * | 2/1996 | Latini et al. | 700/123 |
| 2005/0066538 | A1 * | 3/2005 | Goldberg et al. | 34/218 |
| 2005/0092035 | A1 * | 5/2005 | Shin et al. | 68/275 |
| 2006/0179676 | A1 * | 8/2006 | Goldberg et al. | 34/77 |
| 2007/0271814 | A1 * | 11/2007 | Bae et al. | 34/524 |
| 2008/0104860 | A1 * | 5/2008 | Muenzner et al. | 34/427 |
| 2008/0315000 | A1 * | 12/2008 | Gorthala et al. | 236/46 C |
| 2012/0144692 | A1 * | 6/2012 | Park et al. | 34/491 |
| 2013/0167560 | A1 * | 7/2013 | Wong et al. | 62/56 |

FOREIGN PATENT DOCUMENTS

| | | | | |
|---|---|---|---|---|
| DE | 3215418 | A1 * | 10/1983 | D06F 58/28 |
| DE | 102008031744 | A1 * | 2/2010 | G01P 3/483 |
| EP | 1790769 | A1 * | 5/2007 | |
| JP | 60079255 | A * | 5/1985 | G01N 25/62 |
| JP | 2000061199 | A * | 2/2000 | D06F 58/28 |
| KR | 1996-0004644 | | 2/1996 | |
| KR | 10-0587358 | | 4/2006 | |
| WO | WO 2008077969 | A1 * | 7/2008 | D06F 58/28 |

* cited by examiner

*Primary Examiner* — Steve M Gravini
(74) *Attorney, Agent, or Firm* — Staas & Halsey LLP

(57) ABSTRACT

A dryer and a control method thereof, in which load of an object to be dried is detected using a sensor which has less risk of contamination and an anticipated drying time based on the detected load is accurately determined and displayed. The dryer includes a rotatable drum to accommodate the object, a front support installed at an entrance of the drum to support the drum, a rear support installed at an opposite side of the entrance of the drum to support the drum, an exhaust hole formed in the front support, through which interior air of the drum is discharged, and a humidity sensor installed to the front support at a position adjacent to the exhaust hole, the humidity sensor being located upstream of the exhaust hole in a rotating direction of the drum to detect humidity of the air to be introduced into the exhaust hole.

15 Claims, 7 Drawing Sheets

DRYER

CROSS-REFERENCE TO RELATED APPLICATIONS

This application claims the benefit of Korean Patent Application No. 10-2010-0126854, filed on Dec. 13, 2010 in the Korean Intellectual Property Office, the disclosure of which is incorporated herein by reference.

BACKGROUND

1. Field

Embodiments of the present disclosure relate to a dryer to dry an object accommodated in a drum via circulation of air.

2. Description of the Related Art

In general, a dryer includes a drum in which an object to be dried is accommodated, the drum being rotated to rotate the object, and a heat source (e.g., a heater or a heat pump) to heat air. As a drying fan is rotated to move low-temperature and low-humidity air through the heat source, the low-temperature and low-humidity air is changed into high-temperature and low-humidity air by the heat source. The resulting high-temperature and low-humidity air is introduced into the drum to heat the object to be dried. Then, the high-temperature and low-humidity air is changed into high-temperature and high-humidity air by steam generated while the object is heated. Although an open type dryer directly discharges the high-temperature and high-humidity air to the outside, in the case of a closed type dryer, the high-temperature and high-humidity air is changed into low-temperature and low-humidity air by a condenser which condenses the air to remove moisture from the air. The low-temperature and low-humidity air is changed into high-temperature and low-humidity air while passing through the heat source via rotation of the drying fan and then, is introduced into the drum to heat the object to be dried. This circulation cycle is repeated until the object is completely dried. After the object is completely dried, only a motor is driven and the heat source is not operated, which serves to cool the object to allow a user to easily take the object out of the drum.

The above-described dryer may need to display and inform the user of a remaining drying time until the object is completely dried.

Conventional dryers have been designed to preset a drying time and a cooling time, to display a remaining drying time. A display unit displays the preset drying time which is decremented as time passes during drying and also, displays the preset cooling time which is decremented as time passes during cooling.

However, since these conventional dryers function to display the remaining drying time regardless of load of an object to be dried, i.e. the amount of moisture contained in the object to be dried, there is a great difference between an actual remaining drying time and a remaining drying time displayed on the display unit, resulting in deterioration in the reliability of the dryer.

SUMMARY

It is one aspect of the present disclosure to provide a dryer and a control method thereof, in which load of an object to be dried is detected and an anticipated drying time based on the detected load is accurately determined and displayed.

It is another aspect of the present disclosure to provide a dryer and a control method thereof, in which load of an object is accurately detected using a sensor which has less risk of contamination, which ensures reliable anticipation of a drying time.

Additional aspects of the disclosure will be set forth in part in the description which follows and, in part, will be apparent from the description, or may be learned by practice of the disclosure.

In accordance with one aspect of the disclosure, a dryer includes a drum installed in a rotatable manner and configured to accommodate an object to be dried therein, a front support installed at an entrance of the drum to support the drum, a rear support installed at an opposite side of the entrance of the drum to support the drum, an exhaust hole formed in the front support, through which interior air of the drum is discharged, and a humidity sensor installed to the front support at a position adjacent to the exhaust hole and serving to detect humidity of the air to be introduced into the exhaust hole, wherein the installation position of the humidity sensor allows the air moving in a rotating direction of the drum within the drum to pass a surface of the humidity sensor prior to being discharged through the exhaust hole.

The humidity sensor may be installed to the front support such that a humidity detecting surface of the humidity sensor does not protrude from a surface of the front support.

The dryer may further include an electrode sensor installed to the front support to detect humidity by coming into contact with the object.

The humidity sensor may cooperate with the electrode sensor to enable compensation of a drying time of a drying operation.

The humidity sensor may enable compensation of the drying time by detecting humidity in a section in which humidity detection by the electrode sensor is not possible.

In accordance with another aspect of the disclosure, a dryer includes a drum installed in a rotatable manner and configured to accommodate an object to be dried therein, an exhaust hole formed at an entrance of the drum, through which interior air of the drum is discharged, and a humidity sensor installed at the entrance of the drum at a position adjacent to the exhaust hole, the humidity sensor being installed in front of the exhaust hole on the basis of a rotating direction of the drum to detect humidity of air to be introduced into the exhaust hole.

The dryer may further include a front support installed at the entrance of the drum to support the drum, and the exhaust hole and the humidity sensor may be provided at the front support.

The dryer may further include an electrode sensor to detect humidity by coming into contact with the object to be dried.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
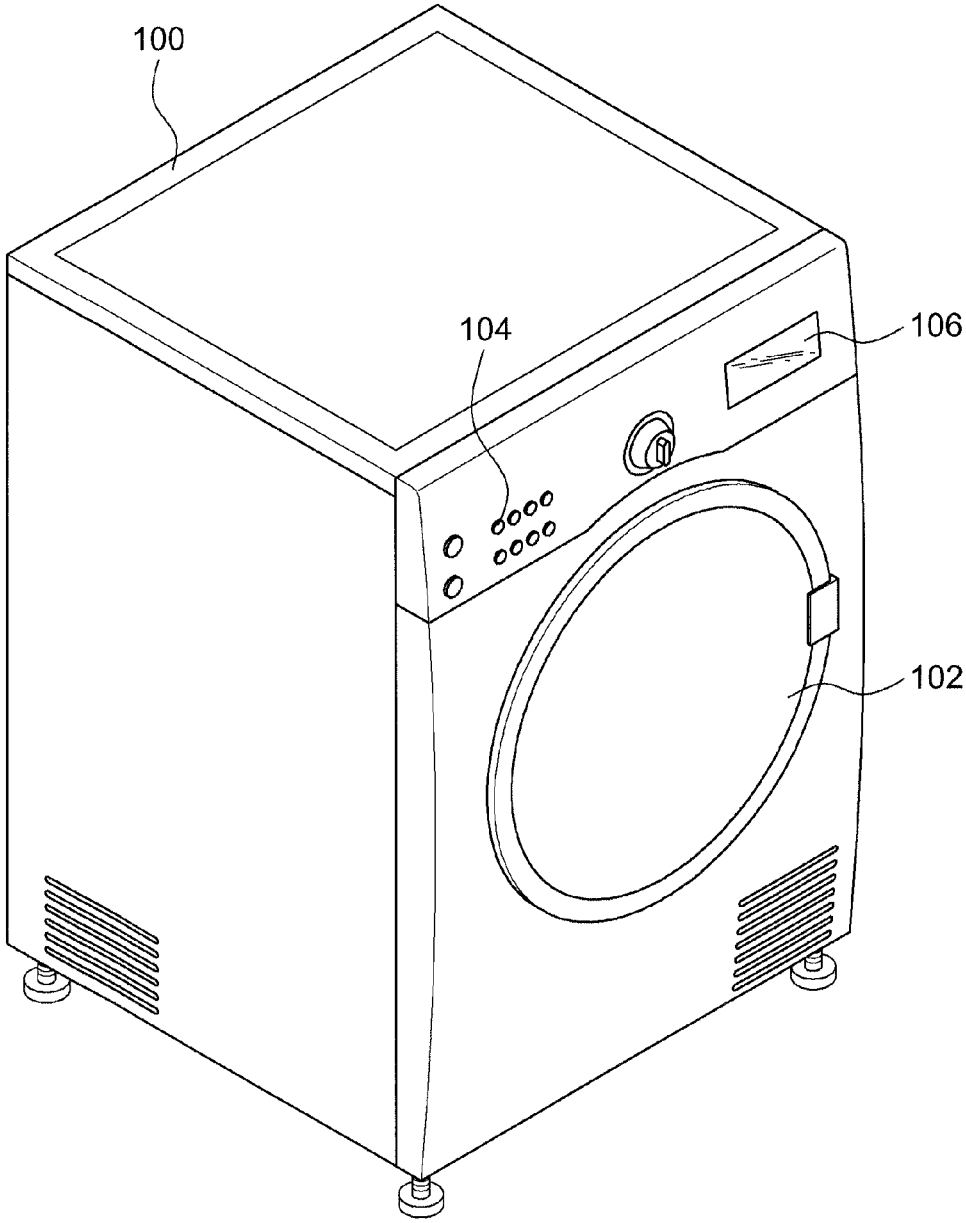
FIG. 1 is a view illustrating a dryer according to an embodiment of the present disclosure.

Reference will now be made in detail to the exemplary embodiment of the present disclosure, examples of which are illustrated in the accompanying drawings, wherein like reference numerals refer to like elements throughout.

FIG. 1 is a view illustrating a dryer according to an embodiment of the present disclosure. As illustrated in FIG. 1, a door 102 is provided at a front opening of a main body 100 of the dryer, an object to be dried being put into or taken out of the dryer through the front opening. A control panel 104, which serves as an input unit, and a display 106, which serves as a display unit, are provided above the door 102 at the front side of the main body 100. The control panel 104 allows a user to input drying conditions (e.g., a desired drying level). The display 106 displays the drying conditions selected by the user or operational states of the dryer (e.g., a current temperature or an anticipated drying time) during operation of the dryer, to allow the user to confirm them.

Figure 2:
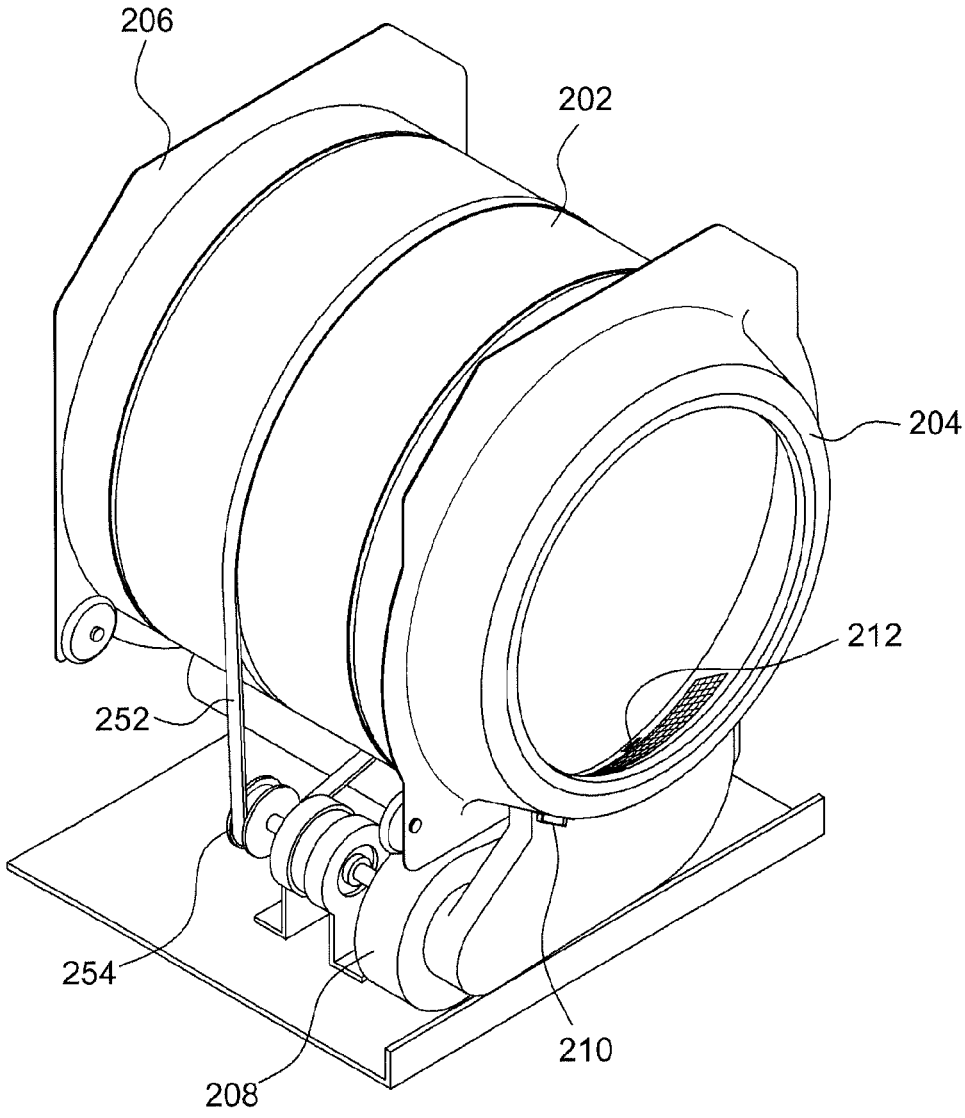
FIG. 2 is a view illustrating one interior structure of the dryer illustrated in FIG. 1.

FIG. 2 is a view illustrating one interior structure of the dryer illustrated in FIG. 1. As illustrated in FIG. 2, a drum 202 is rotatably placed in the main body 100. The drum 202 is rotated clockwise or counterclockwise at a speed of about 50 rpm during drying. A front support 204 and a rear support 206 are provided at front and rear sides of the drum 202. The front support 204 and the rear support 206 are not rotated along with the drum 202. The front support 204 is provided with a humidity sensor 210, in addition to an exhaust hole which will be described hereinafter. The exhaust hole will be described later in more detail with reference to FIG. 3. The front support 204 is an element to allow the humidity sensor 210 and the exhaust hole to be provided at an entrance side of the drum 202. A fan 208 is installed below the drum 202. With rotation of the fan 208, the interior air of the drum 202 is discharged to the outside, or air heated by an external heat source is introduced into the drum 202. The drum 202 is rotated by rotational power of a motor transmitted through a belt 252 and a pulley 254. As such, the drum 202 is only rotated in a given direction.

Figure 3:
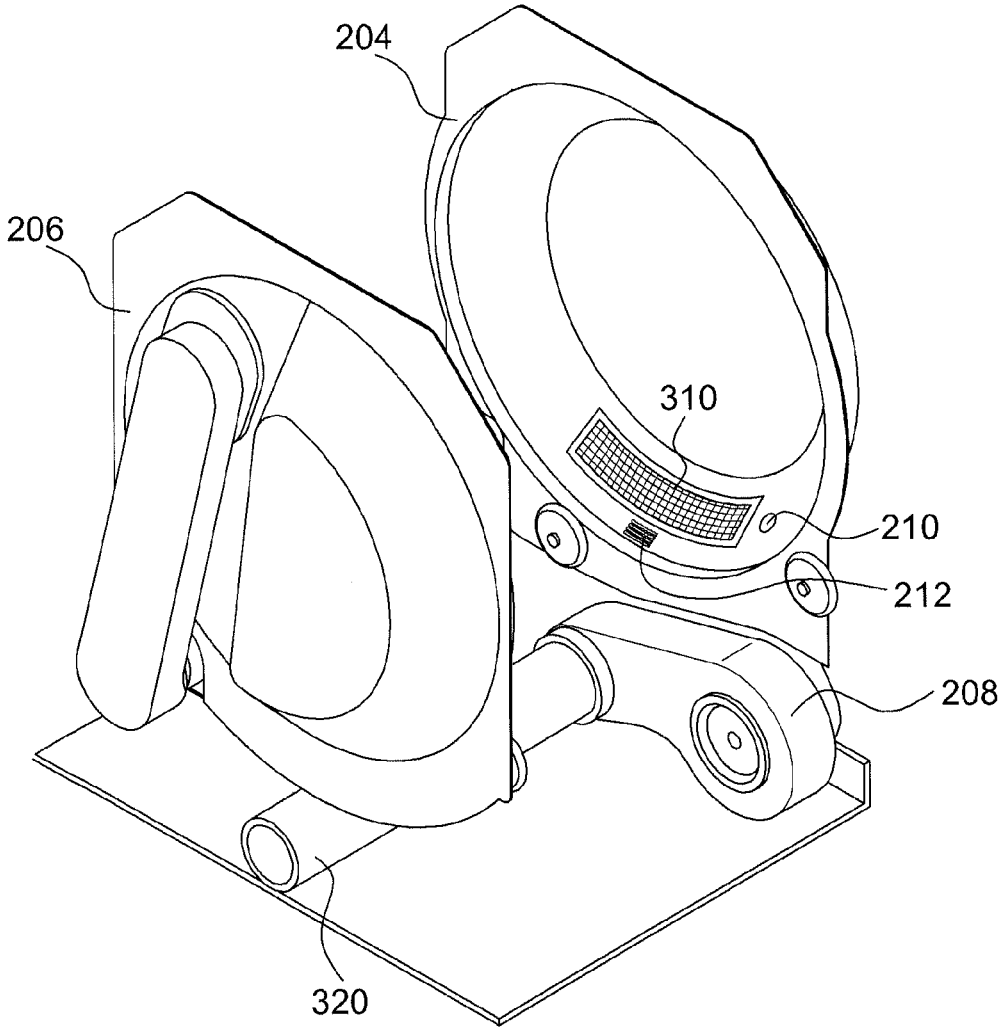
FIG. 3 is a view illustrating another interior structure of the dryer illustrated in FIG. 1.

FIG. 3 is a view illustrating another interior structure of the dryer illustrated in FIG. 1. As illustrated in FIG. 3, the humidity sensor 210 mentioned in the above description of FIG. 2 is installed at an inner surface of the front support 204 facing the drum 202. The humidity sensor 210 serves to detect exhaust conditions of the drum 202, i.e. humidity of the air to be discharged from the drum 202 and has a humidity detecting surface facing the drum 202. The exhaust hole 310 of the front support 204 is located next to the humidity sensor 210. The exhaust hole 310 communicates with an exhaust duct 320 and a filter (not shown) is installed on an exhaust path therebetween. The filter serves to filter out impurities, such as lint, etc., of the air to be discharged from the drum 202 through the exhaust hole 310. In addition, an electrode sensor 212 is provided close to a lower end of the exhaust hole 310. The reason why the humidity sensor 210 and the electrode sensor 212 are installed adjacent to the exhaust hole 310 is to detect humidity of the air to be discharged through the exhaust hole 310 using the humidity sensor 210.

Figure 4:
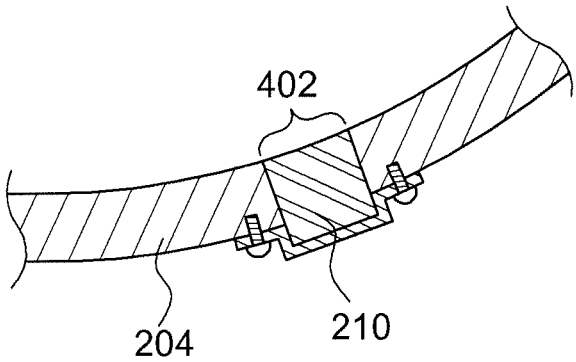
FIG. 4 is a view illustrating an installation configuration of a humidity sensor of the dryer illustrated in FIG. 1.

FIG. 4 is a view illustrating an installation configuration of the humidity sensor of the dryer illustrated in FIG. 1. As illustrated in FIG. 4, the front support 204 is curved. Thus, it may be necessary for the humidity detecting surface 402 of the humidity sensor 210 to be installed relatively level with the inner surface of the front support 204. This ensures that the humidity sensor 210 does not interfere with the object passing through the front support 204.

Figure 5:
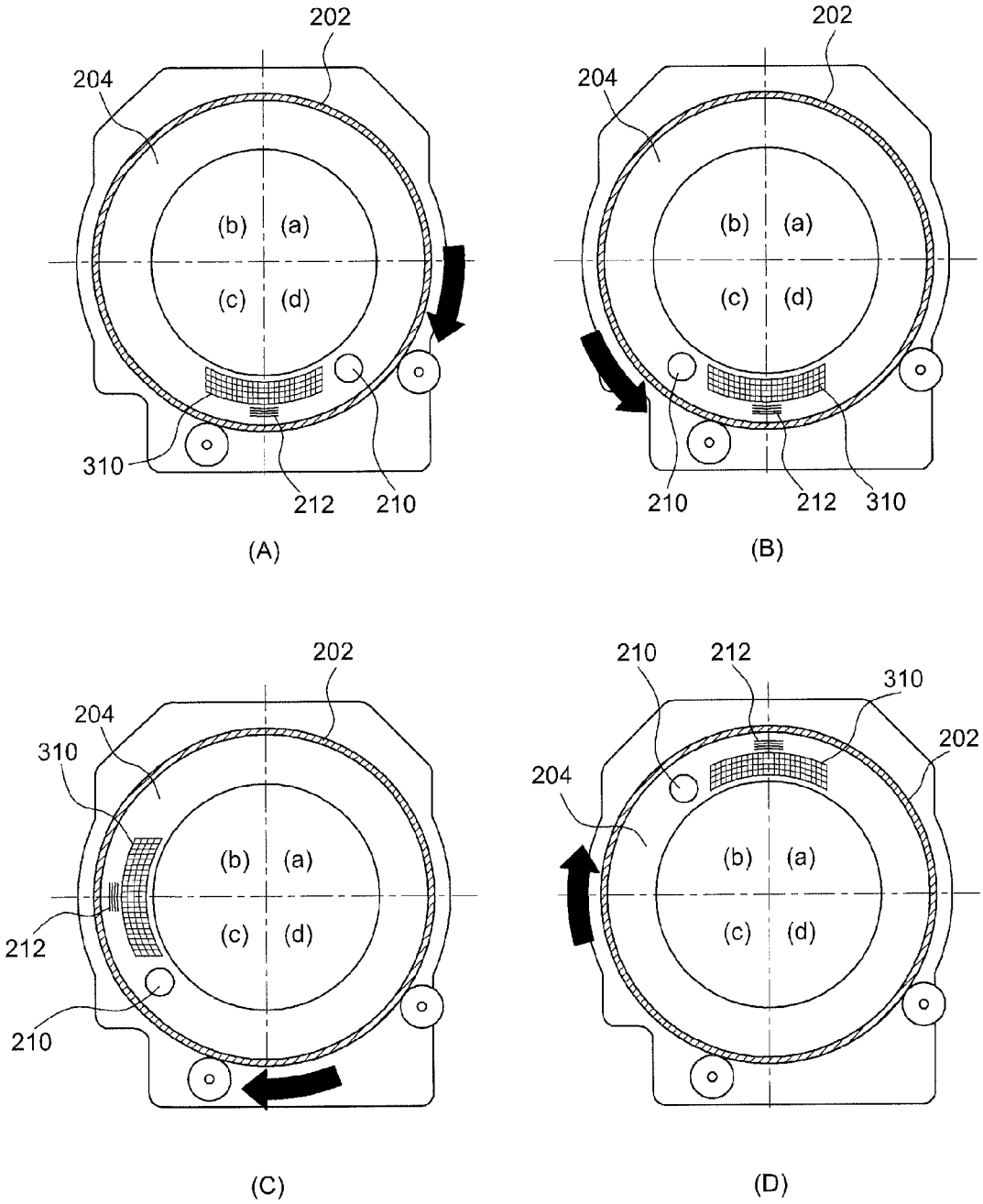
FIG. 5, parts (A)-(D), are views illustrating an installation position of the humidity sensor of the dryer illustrated in FIG. 1 in more detail.

FIG. 5 is a view illustrating an installation position of the humidity sensor of the dryer illustrated in FIG. 1 in more detail. As illustrated in FIG. 5, the installation position of the humidity sensor 210 according to the embodiment of the present disclosure is determined in consideration of a main rotating direction of the drum 202 during drying. Here, the main rotating direction of the drum 202 may be defined as follows. First, assuming that the drum 202 is always rotated only in a given direction, the rotating direction of the drum 202 is the main rotating direction. In another example, assuming that the drum 202 is selectively rotated forward or in reverse as necessary, the rotating direction of the drum 202 under an operating condition in that detection of humidity using the humidity sensor 210 is frequently performed is defined as the main rotating direction. To this end, it may be advantageous that detection of humidity using the humidity sensor 210 be performed only while the drum 202 is rotated in a particular direction. For reference, FIG. 5, parts (A) and (B), illustrate a position of the humidity sensor 210 relative to a position of the exhaust hole. 310 when the entrance of the drum 202 is viewed from the interior of the drum 202. In FIG. 5, part (A), the drum 202 is mainly rotated clockwise, as designated by the arrow, during drying. In this case, the humidity sensor 210 is installed upstream of the rotating direction of the drum 202. The drum 202 is rotated at a speed of about 50 rpm such that the object in the drum 202 is overturned so as to further bring into contact with heated air during drying. During rotation of the drum 202, an air stream (flow of air) is generated in the rotating direction of the drum 202 within the drum 202. The installation position of the humidity sensor 210 in FIG. 5, part (A), is a position suitable to allow the air moving in the rotating direction of the drum 202 within the drum 202 to pass the surface of the humidity sensor 210 immediately before the air is discharged through the exhaust hole 310. Installing the humidity sensor 210 at this position ensures accurate detection of the humidity of the air to be discharged from the drum 202. Different humidity values are detected at different positions within the drum 202, and humidity of the air to be discharged through the exhaust hole 310 may be a representative (average) value of the interior humidity of the drum 202. Thus, detecting the humidity of the air to be discharged through the exhaust hole 310 may be a method of detecting the interior humidity of the interior of the drum 202 with the greatest accuracy. Of course, although installing the humidity sensor 210 at the exhaust hole 310 enables more accurate detection of the humidity of the air, impurities filtered by the exhaust hole 310 may be adhered to the surface of the humidity sensor 210, which may accelerate contamination of the humidity sensor 210. Thus, detecting the humidity of the air immediately before the air passes through the exhaust hole 310 ensures relatively accurate detection of the humidity of the air and minimized contamination of the humidity sensor 210. This position corresponds to the installation position of the humidity sensor 210 illustrated in FIG. 5, part (A). In particular, when installing the humidity sensor 210 to the front support 204, impurities adhered to the surface of the humidity sensor 210 may be removed by coming into contact with the object rotating in the drum 202 during drying. Therefore, the installation position of the humidity sensor 210 in FIG. 5, part (A). is a position suitable to further reduce contamination of the humidity sensor 210. In FIG. 5, part (B), the drum 202 is rotated counterclockwise designated by the arrow. In this case, due to the same reason as the installation position of the humidity sensor 210 of FIG. 5, part (A), the humidity sensor 210 is installed at a position to enable relatively accurate detection of the humidity of the air to be discharged through the exhaust hole 310 while ensuring minimized contamination of the humidity sensor 210. That is, as illustrated in FIG. 5, parts (A) and (B), assuming that a rotation cross section of the drum 202 is divided into quadrants (a), (b), (c) and (d), and the exhaust 310 is formed in six o'clock, the installation position of the humidity sensor 210 is located in the fourth quadrant (d) (FIG. 5, part (A)) or the third quadrant (c) (FIG. 5, part (B)) based on the rotating direction of the drum 202.

Figure 6:
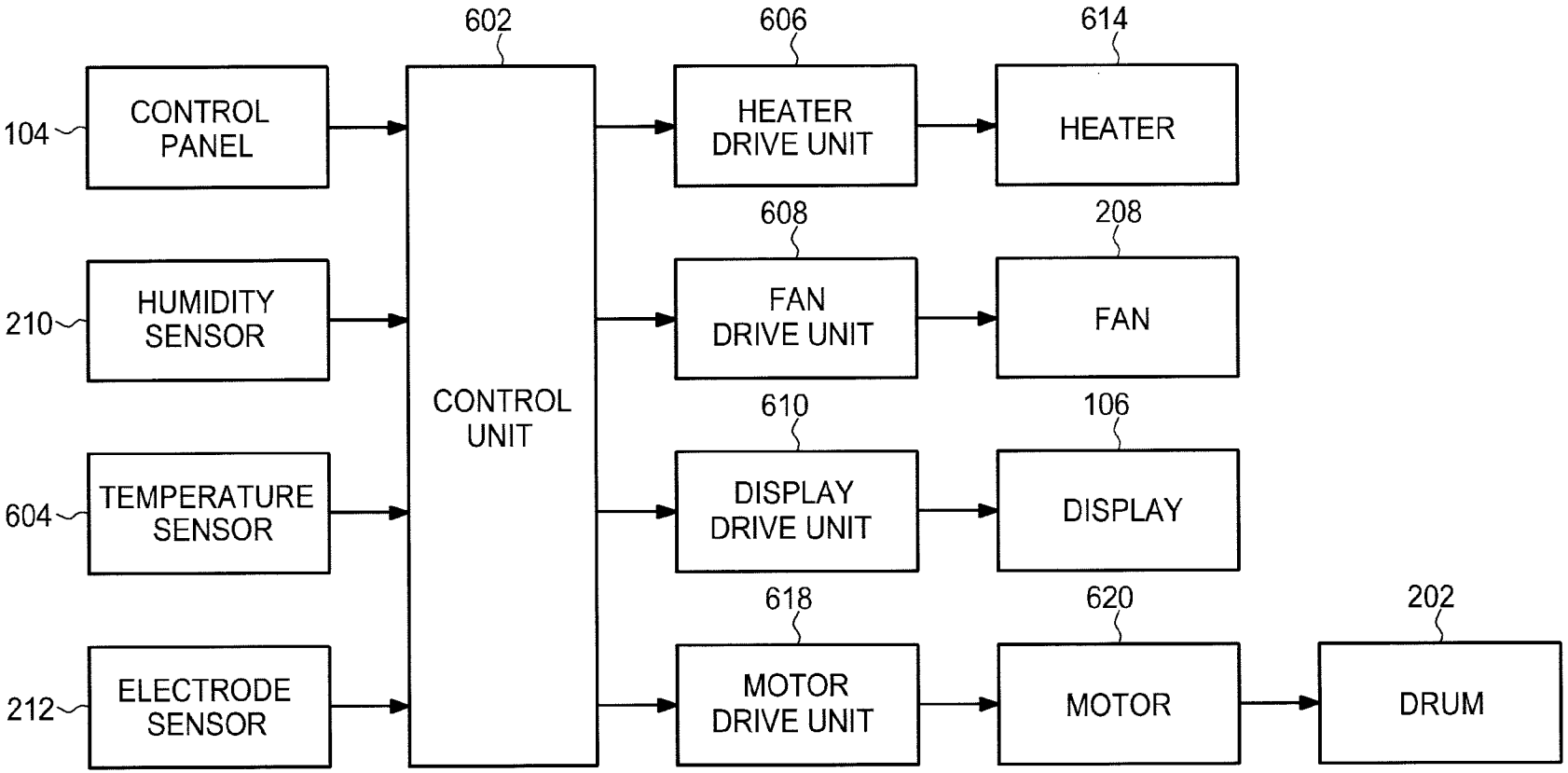
FIG. 6 is a view illustrating a control system of the dryer according to an embodiment of the present disclosure.

FIG. 6 is a view illustrating a control system of the dryer according to an embodiment of the present disclosure. As illustrated in FIG. 6, a control unit 602 to control general operation of the dryer is provided with a reference table (e.g., stored in an internal memory of the control unit 602 or in a separate external memory). Drying experiments are previously performed with respect to various kinds and amounts of objects and with analysis of the resulting experimental data, humidity change and temperature change with respect to the kind and quantity of each test object are obtained. The reference table is prepared using the obtained data. As such, the kind and amount of an object during actual drying may be determined by comparing humidity change and temperature change detected during the actual drying with the previously obtained data.

The control panel 104 as an input unit, the humidity sensor 210, the temperature sensor 604 and the electrode sensor 212 may be connected to an input side of the control unit 602 to enable communication therebetween. The control panel 104 allows the user to input drying conditions (e.g., a desired drying level), and the temperature sensor 604 measures the interior temperature of the drum 202. Measuring the interior temperature of the drum 202 serves to supply air of an appropriate temperature during drying as necessary and to prevent overheating of the drum 202.

A heater drive unit 606, a fan drive unit 608, a display drive unit 610, and a motor drive unit 618 are connected to an output side of the control unit 602 to enable communication therebetween. The heater drive unit 606 heats air by driving a heater 614 that serves as one kind of heat source. Instead of the heater 614, a heat pump may serve as the heat source. The fan drive unit 608 drives a fan 208 to supply heated air into the drum 202. The display drive unit 610 drives the display 106 as a display unit to display information on the display 106. The motor drive unit 618 drives a motor 620 to rotate the drum 202. The display 106 displays drying conditions selected by the user or operational states of the dryer during drying (e.g., a current temperature and a remaining drying time), allowing the user to confirm them.

The control unit 602 drives the heater 614 and the fan 208 via the heater drive unit 606 and the fan drive unit 608 based on the drying conditions (e.g., a desired drying level) input via the control panel 104, thereby allowing hot wind to be supplied into the drum 202. The hot wind is used to dry the object within the drum 202. The control unit 602 controls driving rates of the heater 614 and the fan 208 during drying in consideration of humidity change in the drum 202 detected via the humidity sensor 210 and the electrode sensor 212 and temperature change in the drum 202 detected via the temperature sensor 604. In particular, the control unit 620 calculates an anticipated drying time until the object is dried to a target level based on the humidity change in the drum 202 detected via the humidity sensor 210 and the electrode sensor 212 and the temperature change in the drum 202 detected via the temperature sensor 604. The calculated anticipated drying time is displayed via the display 106. As such, the anticipated drying time displayed on the display 106 informs the user of a remaining drying time until completion of drying. If the humidity sensor 210 does not accurately detect (change of) the interior humidity of the drum 202 and the temperature sensor 604 does not accurately detect (change of) the interior temperature of the drum 202, it is difficult to accurately calculate the anticipated drying time until the object is dried to a target level. This means that the object may be insufficiently or excessively dried as compared to the target level. In addition, if the anticipated drying time is not accurate, the remaining drying time displayed on the display 106 is also inaccurate, losing the reliability of the user. Thus, accurately detecting (change of) the interior humidity of the drum 202 using the humidity sensor 210 and the electrode sensor 212 and (change of) the interior temperature of the drum 202 using the temperature sensor 604 is very important in operation of the dryer.

Figure 7:
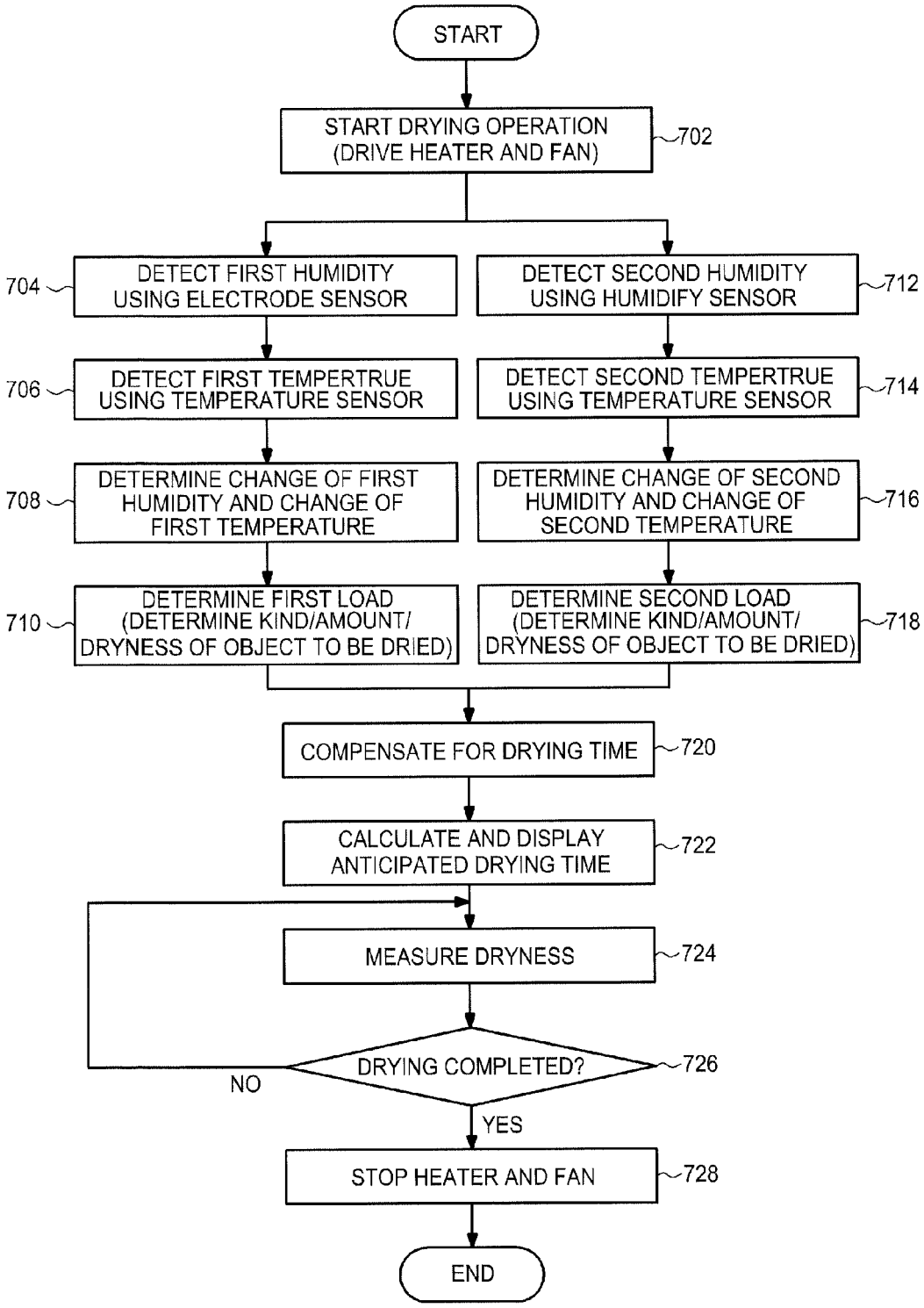
FIG. 7 is a view illustrating a control method of the dryer according to an embodiment of the present disclosure.

FIG. 7 is a view illustrating a control method of the dryer according to an embodiment of the present disclosure. As illustrated in FIG. 7, if the user inputs drying conditions (e.g., a desired drying level) and inputs a drying start command via the control panel 104, the control unit 602 drives the heater 614 and the fan 208 based on the input drying conditions to start drying (702). In the control method illustrated in FIG. 7, first load determination (704 to 710 in FIG. 7) using the electrode sensor 212 and second load determination (712 to 718 in FIG. 7) using the humidity sensor 210 are performed simultaneously although they are independent of each other.

First, in the case of the first load determination (704 to 710 in FIG. 7) using the electrode sensor 212, the control unit 602 detects a first humidity within the drum 202 using the electrode sensor 212 (704) and detects a first temperature within the drum 202 using the temperature sensor 604 (706). The control unit 602 determines first humidity change and first temperature change within the drum 202 from the detected first humidity and first temperature (708). Thereby, the control unit 602 performs the first load determination based on the first humidity change and the first temperature change (710). Here, the first load determination includes determining the kind, amount and dryness of an object to be dried.

In the case of the second load determination (712 to 718 in FIG. 7) using the humidity sensor 210, the control unit 602 detects a second humidity within the drum 202 using the humidity sensor 210 (712) and detects a second temperature within the drum 202 using the temperature sensor 604 (714). The control unit 602 determines second humidity change and second temperature change within the drum 202 from the detected second humidity and second temperature (716). Thereby, the control unit 602 performs the second load determination based on the second humidity change and the second temperature change (718). Here, the second load determination includes determining the kind, amount and dryness of an object to be dried.

Here, according to the progress circumstances of the first load determination (704 to 710 in FIG. 7) and the second load determination (712 to 718 in FIG. 7), a single temperature value or individual temperature values may be detected in the first temperature detection 706 and the second temperature detection 714.

Drying experiments may be previously performed with respect to various kinds and amounts of objects and with analysis of the resulting experimental data, data of humidity change and temperature change with respect to the kind and quantity of each test object may be obtained. The kind and amount of an object during actual drying may be determined by comparing humidity change and temperature change detected during the actual drying with the previously obtained data. In this case, more accurate determination may be possible when considering both the interior temperature of the dryer and an outside temperature around the dryer. In the embodiment of the present disclosure, the control unit 602 utilizes data of the reference table mentioned in the above description of FIG. 6, to determine the kind, amount and dryness of the object.

After completion of both the first load determination and the second load determination, drying time is compensated using results of the first load determination and the second load determination (720). Specifically, since an object begins to dry as moisture is evaporated from the surface of the object, no moisture remains on the surface of the object after drying has progressed to some extent even if the object still contains moisture therein. Thus, the electrode sensor 212, which is devised to detect humidity by coming into direct contact with moisture, may fail to detect humidity (or dryness) if the humidity of the object does not reach a predetermined value. To overcome such a limitation of the electrode sensor 212, although additional drying may be performed for an arbitrary time in a section in which humidity detection using the electrode sensor 212 is not possible, this may cause drying defects, such as insufficient or excessive drying, according to the amount or state of the object. In the embodiment of the present disclosure, instead of the additional drying, the humidity sensor 210 may be used along with the electrode sensor 212 to accurately detect humidity (dryness) even in the section in which humidity detection using the electrode sensor 212 is not possible. With regard to the compensation of drying time 720 in FIG. 7, adopting both the first load determination (704 to 710) using the electrode sensor 212 and the second load determination (712 to 718) using the humidity sensor 210 is that using the two sensors can achieve more accurate detection of humidity than using only a single sensor. In addition, since the electrode sensor 212 having a relatively simple configuration has higher durability than the humidity sensor 210 which is made of semiconductors, adopting both the electrode sensor 212 and the humidity sensor 210 enables detection of humidity using the electrode sensor 210 having the higher durability even if the humidity sensor 210 malfunctions. That is, using both the electrode sensor 212 and the humidity sensor 210 may remarkably improve reliability of the dryer.

The control unit 602 calculates an anticipated drying time based on the drying time compensation results and displays the calculated anticipated drying time on the display 106 (722). Thereby, the user can be informed of a remaining drying time until completion of drying. Dryness in the drum 202 may be continuously detected using the humidity sensor 210 even after calculation of the anticipated drying time is completed (724). This serves to confirm whether or not the dried state of the object reaches a target level. For example, the drying of the object and the detection of dryness are continued before the object is completely dried (No in 726). If the object is completely dried (Yes in 726), the heater 614 and the fan 208 are stopped to end drying (728). When it is desired to cool the object after completion of drying, an operation to circulate unheated air within the drum 202 by stopping only the heater 614 and continuously driving the fan 208 may be added.

As is apparent from the above description, one or more embodiments include a dryer and a control method thereof, in which load of an object to be dried is detected and an anticipated drying time based on the detected load is accurately determined and displayed.

Further, one or more embodiments include a dryer and a control method thereof, in which load of an object to be, dried is accurately determined using a sensor which has less risk of contamination.

Although the embodiment of the present disclosure has been shown and described, it would be appreciated by those skilled in the art that changes may be made in these embodiments without departing from the principles and spirit of the invention, the scope of which is defined in the claims and their equivalents.

What is claimed is:

1. A dryer comprising:

a drum installed in a rotatable manner and configured to accommodate an object to be dried therein;

a front support installed at an entrance of the drum to support the drum;

a rear support installed at an opposite side of the entrance of the drum to support the drum;

an exhaust hole formed in the front support, through which interior air of the drum is discharged; and a humidity sensor installed to the front support at a position adjacent to the exhaust hole and serving to detect humidity of the air to be introduced into the exhaust hole, wherein the installation position of the humidity sensor allows the air moving in a rotating direction of the drum within the drum to pass a surface of the humidity sensor prior to being discharged through the exhaust hole.

2. The dryer according to claim 1, wherein the humidity sensor is installed to the front support such that a humidity detecting surface of the humidity sensor does not protrude from a surface of the front support.

3. The dryer according to claim 1, further comprising an electrode sensor installed to the front support to detect humidity by coming into contact with the object.

4. The dryer according to claim 3, wherein the humidity sensor cooperates with the electrode sensor to enable compensation of a drying time of a drying operation.

5. The dryer according to claim 3, wherein the humidity sensor enables compensation of a drying time by detecting humidity in a section in which humidity detection by the electrode sensor is not possible.

6. A dryer comprising:

a drum installed in a rotatable manner and configured to accommodate an object to be dried therein;

an exhaust hole formed at an entrance of the drum, through which interior air of the drum is discharged; and a humidity sensor installed at the entrance of the drum at a position adjacent to the exhaust hole, the humidity sensor being installed in front of the exhaust hole on the basis of a rotating direction of the drum to detect humidity of air to be introduced into the exhaust hole.

7. The dryer according to claim 6, further comprising a front support installed at the entrance of the drum to support the drum, wherein the exhaust hole and the humidity sensor are provided at the front support.

8. The dryer according to claim 6, further comprising an electrode sensor to detect humidity by coming into contact with the object to be dried.

9. A control method of a dryer having a rotatable drum configured to accommodate an object to be dried, a fan, a heater, a humidity sensor, an electrode sensor, a temperature sensor, a control unit, a display and an input unit, the control method comprising:

inputting drying conditions and a drying start command through the input unit;

driving the heater and the fan based on the input drying conditions to start drying; and determining a first load using the electrode sensor; and determining a second load using the humidity sensor.

10. The control method of claim 9, wherein determining the first load and determining the second load is performed simultaneously.

11. The control method of claim 9, wherein determining the first load comprises detecting a first humidity within the drum using the electrode sensor and detecting a first temperature within the drum using the temperature sensor.

12. The control method of claim 11, wherein determining the second load comprises detecting a second humidity within the drum using the humidity sensor and detecting a second temperature within the drum using the temperature sensor.

13. The control method of claim 12, further comprising, after completion of determining both the first load and the second load, compensating drying time using results of the first load determination and the second load determination.

14. The control method of claim 13, further comprising:

calculating an anticipated drying time based on the compensated drying time compensation results; and displaying the calculated anticipated drying time.

15. The control method of claim 14, further comprising:

continuously detecting dryness in the drum using the humidity sensor even after calculation of the anticipated drying time is completed; and wherein when the object is completely dried, stopping operation of the heater and the fan to end drying.

* * * * *